US011440164B1

(12) United States Patent
Chen

(10) Patent No.: US 11,440,164 B1
(45) Date of Patent: Sep. 13, 2022

(54) COAXIAL CLAMP

(71) Applicant: YUN KUAN ENTERPRISE CO., LTD., Tongluo Township, Miaoli County (TW)

(72) Inventor: Wen-Che Chen, Tongluo Township, Miaoli County (TW)

(73) Assignee: YUN KUAN ENTERPRISE CO., LTD., Miaoli County (TW)

( * ) Notice: Subject to any disclaimer, the term of this patent is extended or adjusted under 35 U.S.C. 154(b) by 0 days.

(21) Appl. No.: 17/350,937

(22) Filed: Jun. 17, 2021

(51) Int. Cl.
*B25B 5/06* (2006.01)
*B25B 5/16* (2006.01)

(52) U.S. Cl.
CPC ..... *B25B 5/068* (2013.01); *B25B 5/166* (2013.01)

(58) Field of Classification Search
CPC ..... B25B 5/068; B25B 5/166; B25B 5/00; B25B 5/067; B25B 5/082; B25B 5/101; B25B 5/02; B25B 5/085; B25B 5/102; B25B 5/127
USPC ..... 269/43, 3, 6, 95, 143, 249
See application file for complete search history.

(56) References Cited

U.S. PATENT DOCUMENTS

2007/0187879 A1* 8/2007 Ben-Gigi ..... B25B 5/04 269/6

* cited by examiner

*Primary Examiner* — Joseph J Hail
*Assistant Examiner* — Caleb Andrew Holizna

(57) ABSTRACT

A clamp contains: a first clamping assembly, a second clamping assembly, and a guide shaft. The first clamping assembly includes a base, a first clamper, a first connection member, and a first buffer. The base has a grip, an operation lever, and a release lever. The base further includes a release structure driven by the release lever to remove the base from the guide shaft. The second clamping assembly includes a second clamper, a second connection member, and a second buffer. The first buffer accommodates the guide shaft, and the second buffer is fitted on and is rotated with respect to an outer wall of the second connection member. The second clamper is fitted on the second buffer and the second connection member, the second clamper is rotatable relative to the second connection member, and the second clamper and the second buffer are connected with the second connection member.

4 Claims, 6 Drawing Sheets

COAXIAL CLAMP

FIELD OF THE INVENTION

The present invention relates to a clamp which is capable of adjustably rotating the first clamping assembly and the second clamping assembly 360 degrees along the guide shaft easily so as to clamp an irregular workpiece freely.

BACKGROUND OF THE INVENTION

A conventional clamp is applied to clamp workpieces (formed in a plate shape) made of wood, metal or plastic. However, it is difficult to clamp irregular workpiece easily.

Another improved clamp is disclosed in TW Patent No. M 284485 and is formed in a gun shape. The clamp contains two opposite paws, a movable clamper, and a fixed clamper. The movable clamper is fixed on an end of a guide shaft and is slidably received in the fixed clamper. The fixed clamper has two grips extending from two side of a bottom, and a respective grip has a release sheet, and the fixed clamper has a press handle rotatably connected on the fixed clamper, wherein the release sheet and the press handle are configured to drive an engagement set and a limitation set of the fixed clamper. After pressing the press handle, the guide shaft is pulled to drive the movable clamper to clamp with the fixed clamper.

However, the movable clamper is driven to clamp with the fixed clamper at a fixed angle, so it is difficult to clamp the irregular workpiece.

The present invention has arisen to mitigate and/or obviate the afore-described disadvantages.

SUMMARY OF THE INVENTION

The primary aspect of the present invention is to provide a clamp which is capable of adjustably rotating the first clamping assembly and the second clamping assembly 360 degrees along the guide shaft easily so as to clamp an irregular workpiece freely.

To obtain the above mentioned aspects, a clamp provided by the present invention contains: a first clamping assembly, a second clamping assembly, and a guide shaft.

The first clamping assembly includes a base, a first clamper, a first connection member, and a first buffer. The base has a grip formed on an end of the base, and the guide shaft is inserted through the base. The base has an operation lever and a release lever which are formed on an outer wall of the base, such that the base is driven by the operation lever to pull the guide shaft to move.

The base further includes a release structure driven by the release lever to remove the base from the guide shaft, the first clamper accommodates the guide shaft, and the first buffer is fitted on and rotated with respect to an outer wall of the first connection member. The first clamper is fitted on the first buffer and the first connection member, the first clamper is rotatable relative to the first connection member, and the first clamper and the first buffer are connected with the base.

The second clamping assembly includes a second clamper, a second connection member, and a second buffer. The first buffer accommodating the guide shaft, the second buffer is fitted on and rotated with respect to an outer wall of the second connection member. The second clamper is fitted on the second buffer and the second connection member, the second clamper is rotatable relative to the second connection member, and the second clamper and the second buffer are connected with the second connection member.

The first clamping assembly further includes a first positioning structure which has a first spring and a first steel ball. The first connection member has a first receiving orifice defined therein and configured to accommodate the first spring and the first steel ball. The first buffer has multiple first fixing orifices defined therearound and corresponding to the guide shaft, and the first steel ball is urged by the first spring to abut against one of the multiple first fixing orifices selectively. The second clamping assembly further includes a second positioning structure which has a second spring and a second steel ball. The second connection member has a second receiving orifice defined therein and configured to accommodate the second spring and the second steel ball. The second buffer has multiple second fixing orifices defined therearound and corresponding to the guide shaft, and the second steel ball is urged by the first spring to abut against one of the multiple second fixing orifices selectively.

Preferably, the first buffer has at least one first protrusion formed on an outer wall thereof and the first clamper has at least one first recess defined thereon and configured to accommodate the at least one first protrusion. The second buffer has at least one second protrusion formed on an outer wall thereof, and the second clamper has at least one second recess defined thereon and configured to accommodate the at least one second protrusion.

Preferably, the first clamper further has a first securing plate extending from two sides of a bottom thereof, and the second clamper further has a second securing plate extending from two sides of a bottom thereof.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
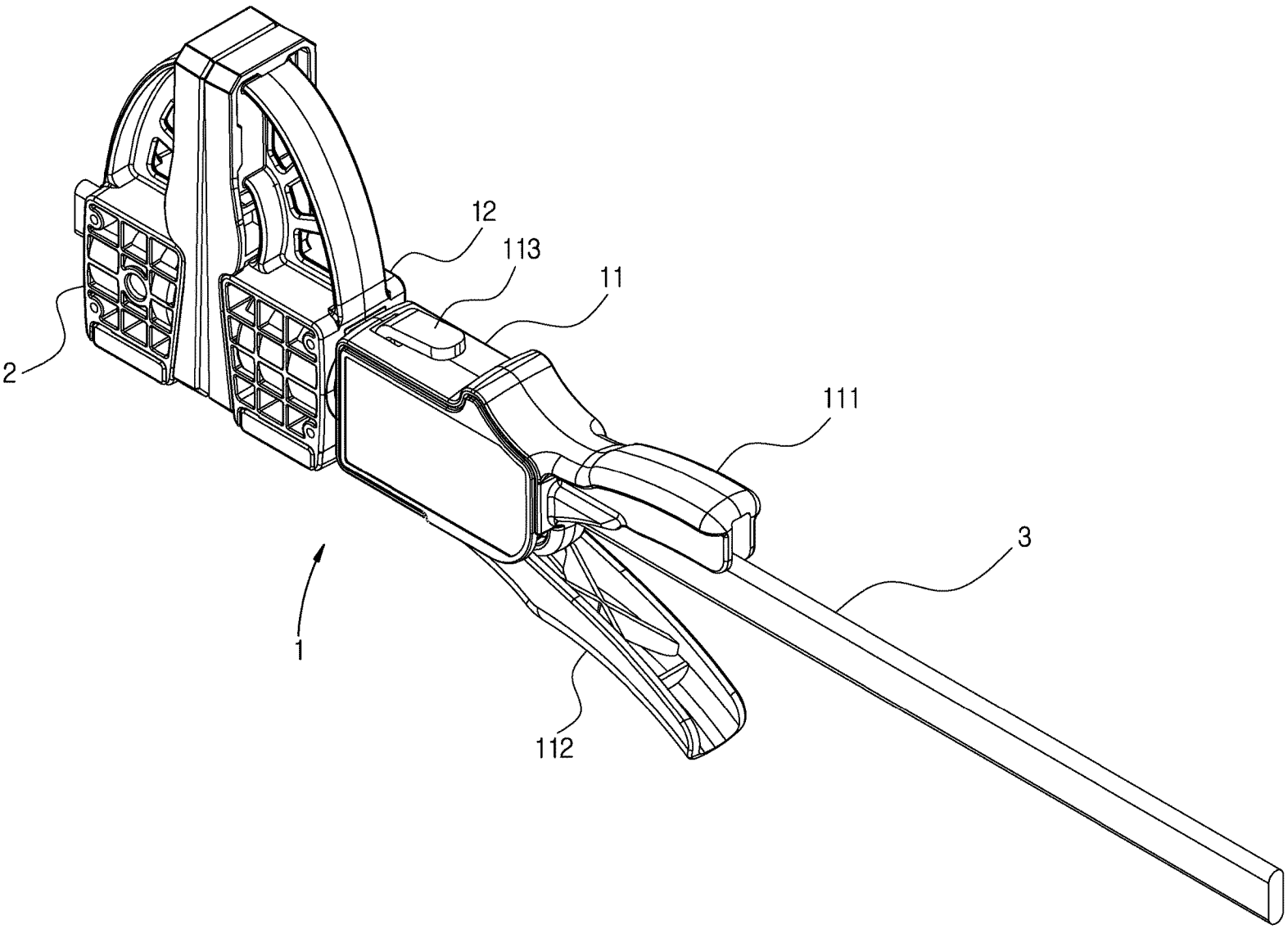
FIG. 1 is a perspective view showing the assembly of a clamp according to a first embodiment of the present invention.
Figure 2:
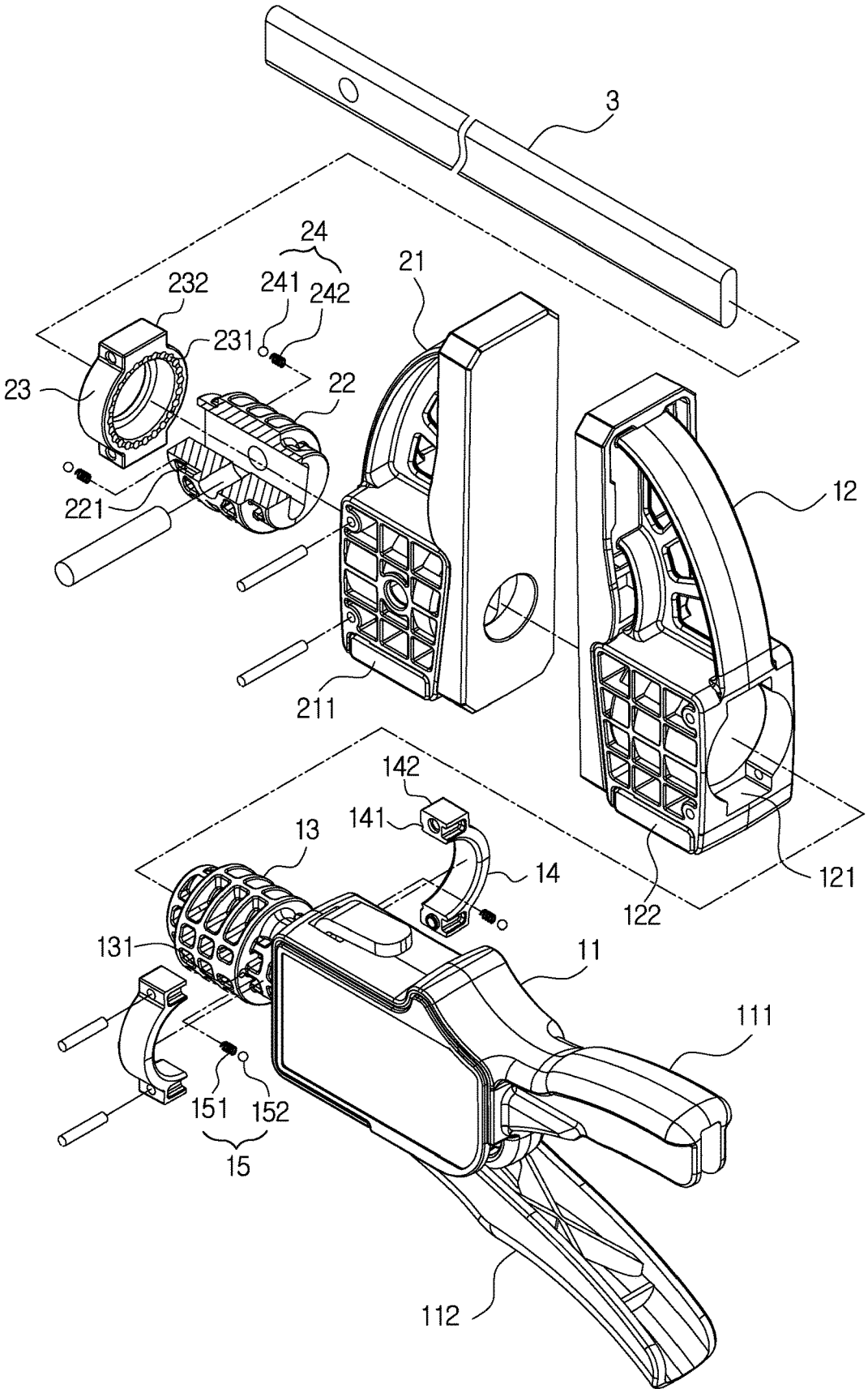
FIG. 2 is a perspective view showing the exploded components of the clamp according to the first embodiment of the present invention.
Figure 3:
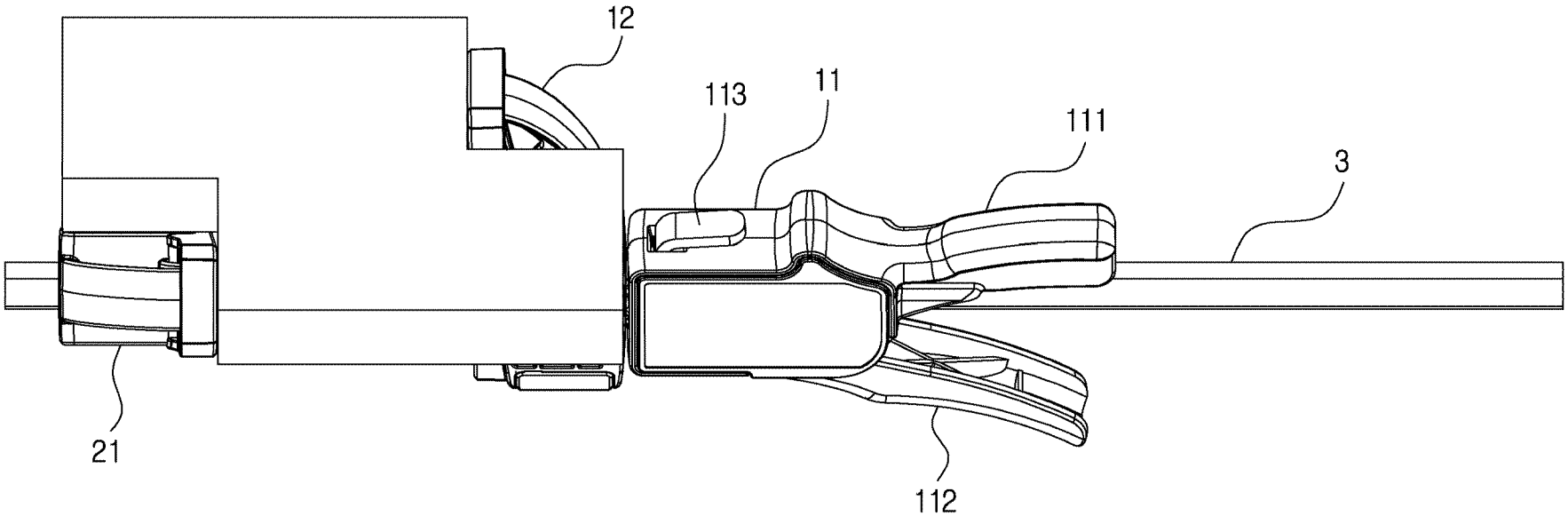
FIG. 3 is a side plan view showing the operation of the clamp according to the first embodiment of the present invention.

With reference to FIGS. 1-3, a clamp according to a preferred embodiment of the present invention is capable of adjusting an optimized clamped position of a workpiece by rotating a first clamping assembly 1 and a second clamping assembly 2 along a guide shaft 3 easily.

The first clamping assembly 1 includes a base 11, a first clamper 12, a first connection member 13, and a first buffer 14. The base 11 has a grip 111 formed on an end thereof, and the guide shaft 3 is inserted through the base 11, wherein the base 11 has an operation lever 112 and a release lever 113 which are formed on an outer wall of the base 11, such that the base 11 is driven by the operation lever 112 to pull the guide shaft 3 to move. Since a drive structure of the base 11 is a well-known art applicable for a clamp, further remarks are omitted.

The base 11 further includes a release structure driven by the release lever 113 to remove the base 11 from the guide shaft 3. Due to the release structure is a well-known art, further remarks are omitted. The first clamper 12 accommodates the guide shaft 3, and the first buffer 14 is fitted on and is rotated with respect to an outer wall of the first connection member 13, wherein the first clamper 12 is fitted on the first buffer 14 and the first connection member 13, the first clamper 12 is rotatable relative to the first connection member 13, and the first clamper 12 and the first buffer 14 are connected with the base 11.

The second clamping assembly 2 includes a second clamper 21, a second connection member 22, and a second buffer 23. The first buffer 22 accommodates the guide shaft 3, the second buffer 23 is fitted on and is rotated with respect to an outer wall of the second connection member 22, wherein the second clamper 21 is fitted on the second buffer 23 and the second connection member 22, the second clamper 21 is rotatable relative to the second connection member 22, and the second clamper 21 and the second buffer 23 are connected with the second connection member 22.

When the operation lever 112 is pressed repeatedly, the guide shaft 3 pulls the second clamping assembly 2 to move to the second clamping assembly 1 so as to clamp the workpiece. Furthermore, the first clamper 12 is rotatable relative to the first connection member 13, and the second clamper 21 is rotatable relative to the second connection member 22, such that the first clamper 12 and the second clamper 21 are rotated along the guide shaft 3 with respective to the base 11, thus adjustably clamping a workpiece formed in an irregular shape, as shown in FIG. 3.

The first clamping assembly 1 further includes a first positioning structure 15 which has a first spring 151 and a first steel ball 152, wherein the first connection member 13 has a first receiving orifice 131 defined therein and configured to accommodate the first spring 151 and the first steel ball 152. The first buffer 14 has multiple first fixing orifices 141 defined therearound and corresponding to the guide shaft 3, and the first steel ball 152 is urged by the first spring 151 to abut against one of the multiple first fixing orifices 141 selectively. The second clamping assembly 2 further includes a second positioning structure 24 which has a second spring 241 and a second steel ball 242, wherein the second connection member 22 has a second receiving orifice 221 defined therein and configured to accommodate the second spring 241 and the second steel ball 242. The second buffer 23 has multiple second fixing orifices 231 defined therearound and corresponding to the guide shaft 3, and the second steel ball 242 is urged by the first spring 241 to abut against one of the multiple second fixing orifices 231 selectively. Thereby, when the first clamper 12 is rotated, the first steel ball 152 is engaged with the one first fixing orifice 141, thus adjusting the optimized clamped position of the workpiece. Also, when the second clamper 21 is rotated, the second steel ball 242 is engaged on the one second fixing orifice 231, thus adjusting the optimized clamped position to the workpiece.

The first buffer 14 has at least one first protrusion 142 formed on an outer wall thereof, and the first clamper 12 has at least one first recess 121 defined thereon and configured to accommodate the at least one first protrusion 142. The second buffer 23 has at least one second protrusion 232 formed on an outer wall thereof, and the second clamper 21 has at least one second recess (not shown but symmetrical to the at least one recess) defined thereon and configured to accommodate the at least one second protrusion 232.

Figure 4:
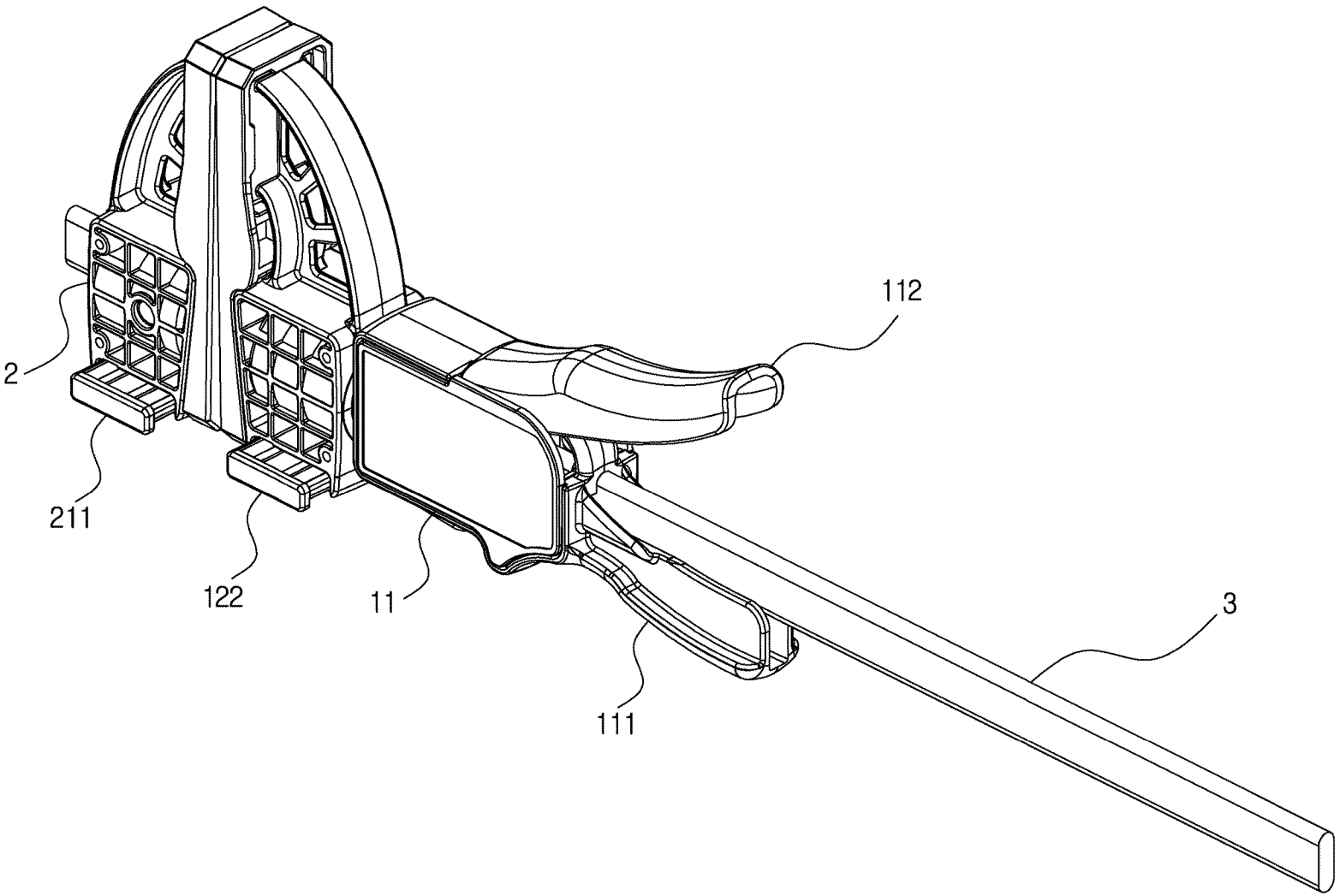
FIG. 4 is a perspective view showing the operation of the clamp according to the first embodiment of the present invention.

The first clamper 12 further has a first securing plate 122 extending from two sides of a bottom thereof, and the second clamper 21 further has a second securing plate 211 extending from two sides of a bottom thereof so as to place the clamp stably, as shown in FIG. 4.

Figure 5:
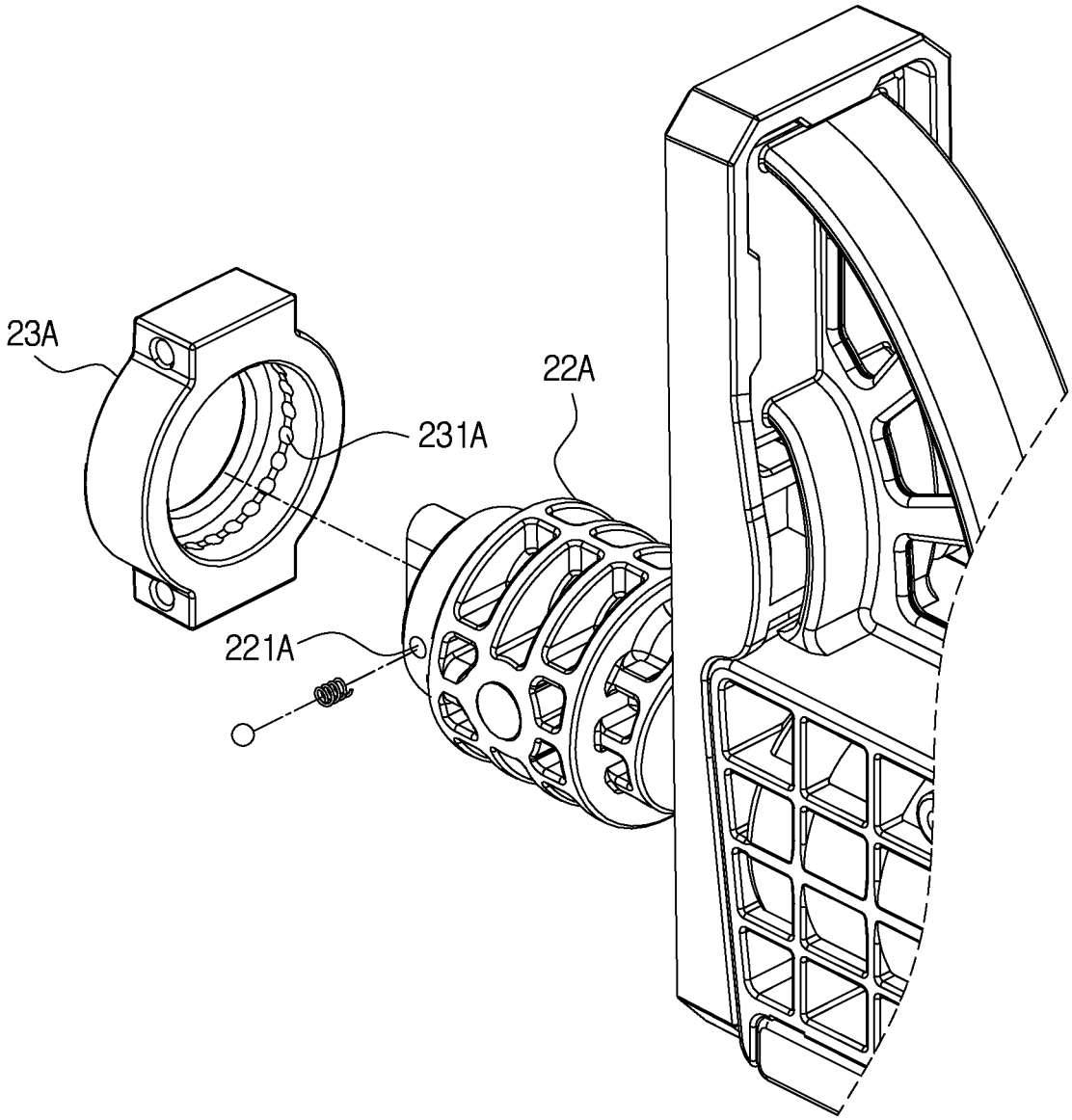
FIG. 5 is a perspective view showing the exploded components of a part of a clamp according to a second embodiment of the present invention.

Referring to FIG. 5, a difference of a clamp of a second embodiment from that of the clamp of the first embodiment comprises: a second connection member 22A and a second buffer 23A, wherein the second connection member 22A has a second receiving orifice 221A located different from the second receiving orifice 221 of the first embodiment, and the second receiving orifice 221A is configured to accommodate the second spring and a second steel ball.

Figure 6:
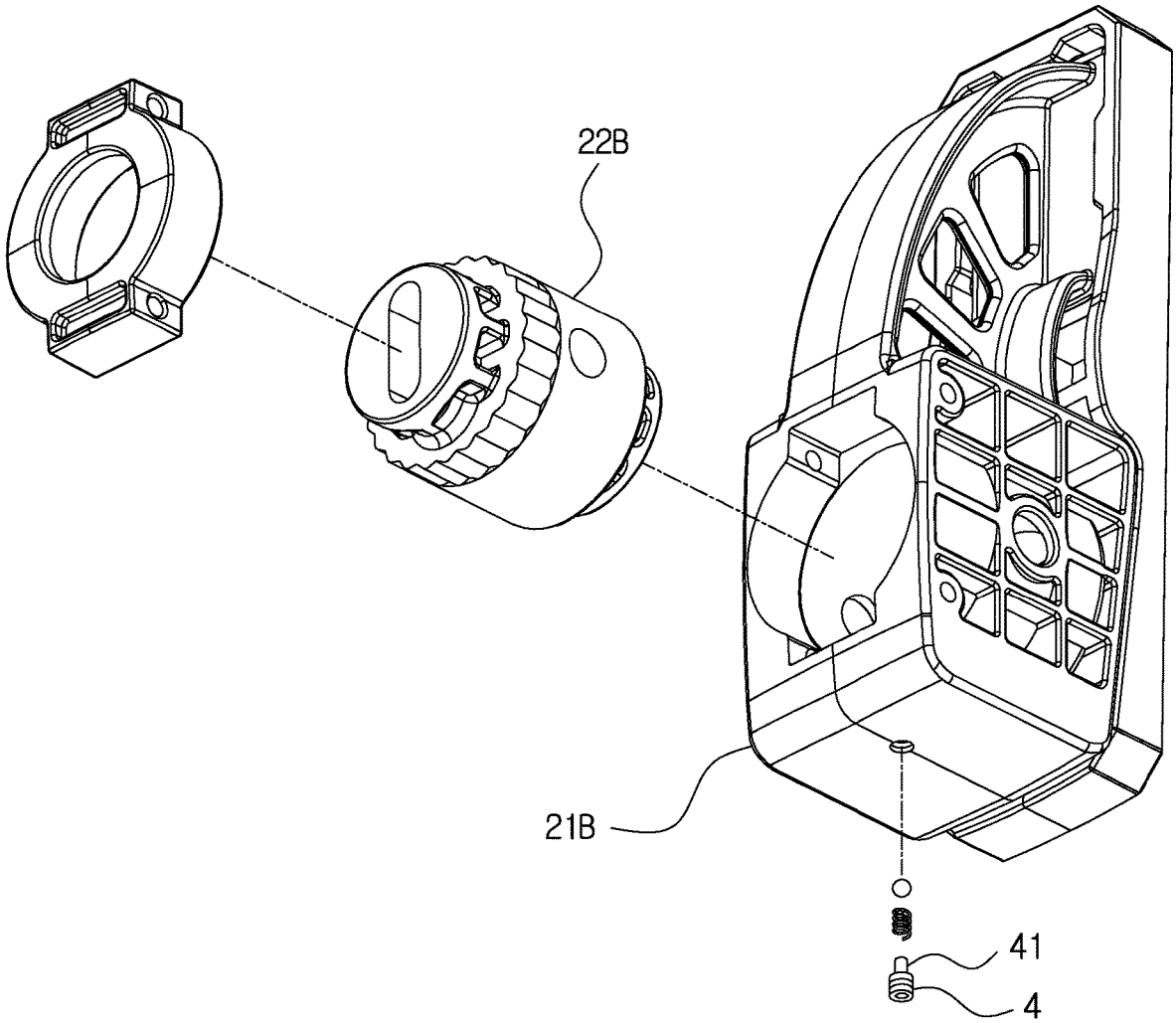
FIG. 6 is a perspective view showing the exploded components of a part of a clamp according to a third embodiment of the present invention.

With reference to FIG. 6, a difference of a clamp of a third embodiment from that of the first embodiment comprises: a second connection element 22B and a second clamper 21B, wherein the second connection element 22B has a wavy defining ring formed thereon, and the second clamper 21B has a receiving orifice defined on a bottom thereof and configured to receive the second spring and the second steel ball. In addition, a screw 4 has an extension 41 configured to inserting through the second spring, wherein a length of the extension 41 is less than a length of the second spring. When the screw 4 is rotated loosely, the second steel ball is urged by the second spring loosely to be fixed adjustably. When the screw 4 is rotated tightly, the second spring is urged by the screw to retract so that the extension 41 pushes the second steel ball directly to engage with the wavy defining ring firmly.

Accordingly, the first clamping assembly 1 and the second clamping assembly 2 are adjustably rotated 360 degrees along the guide shaft 3 easily so as to clamp the irregular workpiece freely.

While various embodiments in accordance with the present invention have been shown and described, it is clear to those skilled in the art that further embodiments may be made without departing from the scope of the present invention.

What is claimed is:

1. A clamp comprising: a first clamping assembly, a second clamping assembly, and a guide shaft;

the first clamping assembly including a base, a first clamper, a first connection member, and a first buffer; the base having a grip formed on an end of the base, and the guide shaft being inserted through the base, wherein the base has an operation lever and a release lever which are formed on an outer wall of the base, such that the base is driven by the operation lever to pull the guide shaft to move;

the base further including a release structure driven by the release lever to remove the base from the guide shaft, the first clamper accommodating the guide shaft, and the first buffer being fitted on and rotated with respect to an outer wall of the first connection member, wherein the first clamper is fitted on the first buffer and the first connection member, the first clamper is rotatable relative to the first connection member, and the first clamper and the first buffer are connected with the base;

the second clamping assembly including a second clamper, a second connection member, and a second buffer, the first buffer accommodating the guide shaft, the second buffer being fitted on and rotated with respect to an outer wall of the second connection member, wherein the second clamper is fitted on the second buffer and the second connection member, the second clamper is rotatable relative to the second connection member, and the second clamper and the second buffer are connected with the second connection member.

2. The clamp as claimed in claim 1, wherein the first clamping assembly further includes a first positioning structure which has a first spring and a first steel ball, wherein the first connection member has a first receiving orifice defined therein and configured to accommodate the first spring and the first steel ball; the first buffer has multiple first fixing orifices defined therearound and corresponding to the guide shaft, and the first steel ball is urged by the first spring to abut against one of the multiple first fixing orifices selectively; the second clamping assembly further includes a second positioning structure which has a second spring and a second steel ball, wherein the second connection member has a second receiving orifice defined therein and configured to accommodate the second spring and the second steel ball; the second buffer has multiple second fixing orifices defined therearound and corresponding to the guide shaft, and the second steel ball is urged by the first spring to abut against one of the multiple second fixing orifices selectively.

3. The clamp as claimed in claim 1, wherein the first buffer has at least one first protrusion formed on an outer wall thereof, and the first clamper has at least one first recess defined thereon and configured to accommodate the at least one first protrusion; the second buffer has at least one second protrusion formed on an outer wall thereof, and the second clamper has at least one second recess defined thereon and configured to accommodate the at least one second protrusion.

4. The clamp as claimed in claim 1, wherein the first clamper further has a first securing plate extending from two sides of a bottom thereof, and the second clamper further has a second securing plate extending from two sides of a bottom thereof.

* * * * *